US008013508B2

(12) United States Patent
Boenigk et al.

(10) Patent No.: US 8,013,508 B2
(45) Date of Patent: Sep. 6, 2011

(54) HIGH-PRESSURE DISCHARGE LAMP

(75) Inventors: Michael Boenigk, Berlin (DE); Dirk Grundmann, Berlin (DE); Matthias Lau, Berlin (DE); Andreas Naujoks, Birkenwerder (DE); Melanie Roth, Berlin (DE)

(73) Assignee: OSRAM AG, Munich (DE)

( * ) Notice: Subject to any disclaimer, the term of this patent is extended or adjusted under 35 U.S.C. 154(b) by 242 days.

(21) Appl. No.: 12/223,804

(22) PCT Filed: Feb. 6, 2007

(86) PCT No.: PCT/EP2007/051129

§ 371 (c)(1),
(2), (4) Date: Aug. 11, 2008

(87) PCT Pub. No.: WO2007/093525

PCT Pub. Date: Aug. 23, 2007

(65) Prior Publication Data

US 2009/0009084 A1 Jan. 8, 2009

(30) Foreign Application Priority Data

Feb. 15, 2006 (DE) ..... 10 2006 007 218

(51) Int. Cl.
*H01J 1/62* (2006.01)

(52) U.S. Cl. ..... 313/489; 313/573; 313/574; 313/594

(58) Field of Classification Search ..... 313/489, 313/573, 574, 594
See application file for complete search history.

(56) References Cited

U.S. PATENT DOCUMENTS

| | | | | |
|---|---|---|---|---|
| 2,707,247 | A * | 4/1955 | Anderson, Jr. | 313/571 |
| 4,701,664 | A * | 10/1987 | Larue et al. | 313/112 |
| 4,804,886 | A * | 2/1989 | Nolan et al. | 313/489 |
| 5,689,154 | A * | 11/1997 | Barthelmes et al. | 313/635 |
| 6,153,982 | A | 11/2000 | Reiners | |
| 6,445,129 | B1 | 9/2002 | Seiler et al. | |
| 6,552,502 | B2 | 4/2003 | Okamoto et al. | |
| 6,664,733 | B2 | 12/2003 | Harada et al. | |
| 6,906,462 | B1 | 6/2005 | Gorille | |
| 7,187,131 | B2 * | 3/2007 | Budinger | 313/303 |
| 7,271,547 | B2 | 9/2007 | Hirschmann et al. | |
| 7,705,540 | B2 * | 4/2010 | Bedynek et al. | 313/635 |
| 7,772,749 | B2 * | 8/2010 | Aurongzeb et al. | 313/112 |
| 2006/0049764 | A1 * | 3/2006 | Bedynek et al. | 313/637 |

FOREIGN PATENT DOCUMENTS

| | | |
|---|---|---|
| DE | 10 2004 57 852 A1 | 6/2006 |
| EP | 0 991 107 B1 | 4/2000 |
| EP | 1 659 835 A1 | 5/2006 |

(Continued)

OTHER PUBLICATIONS

English-language abstract of JP 7-262967 A.

*Primary Examiner* — Peter Macchiarolo

(57) ABSTRACT

The invention relates to a high-pressure discharge lamp having a discharge vessel (10) sealed at both ends, a filling which can be ionized and is enclosed in the discharge area (106) of the discharge vessel (10), and electrodes (11, 12) which extend into the discharge area (106), in order to produce a gas discharge, with the discharge vessel (10) having an electrically conductive coating (107) which is designed as a starting aid and is arranged at least in the boundary area (109) between the discharge area (106) and a first sealed end (102) of the discharge vessel (10).

12 Claims, 3 Drawing Sheets

FOREIGN PATENT DOCUMENTS

| | | | |
|---|---|---|---|
| JP | 6-60851 | A | 3/1994 |
| JP | 6-290754 | A | 10/1994 |
| JP | 7262967 | A | 10/1995 |
| JP | 10-134773 | A | 5/1998 |
| JP | 2000215845 | A | 8/2000 |
| JP | 2002270386 | A | 9/2002 |
| JP | 2005-129400 | A | 5/2005 |
| WO | 01/37319 | A1 | 5/2001 |
| WO | 01/73817 | A1 | 10/2001 |
| WO | 2006/076879 | A1 | 7/2006 |

* cited by examiner

HIGH-PRESSURE DISCHARGE LAMP

I. PRIOR ART

The European patent specification EP 0 991 107 B1 describes, on page 4, lines 12 to 26 of column 6, a high-pressure discharge lamp with a base at one end for a motor vehicle headlamp which has a discharge vessel surrounded by a vitreous outer bulb, the outer bulb being provided with a transparent, electrically conductive layer, which extends over the entire discharge space of the lamp. This layer is connected to the circuit-internal ground reference potential of the control gear of the high-pressure discharge lamp in order to improve the electromagnetic compatibility of the lamp.

II. DESCRIPTION OF THE INVENTION

The object of the invention is to provide a high-pressure discharge lamp, in particular a mercury-free metal-halide high-pressure discharge lamp for vehicle headlamps with an improved ignition response.

This object is achieved according to the invention by the features of claim 1. Particularly advantageous embodiments of the invention are described in the dependent claims.

The high-pressure discharge lamp according to the invention has a discharge vessel which is sealed at two ends, an ionizable filling which is enclosed in the discharge space of the discharge vessel and electrodes, which extend into the discharge space, for generating a gas discharge, the discharge vessel having an electrically conductive coating, which is in the form of an ignition aid and is arranged at least in the boundary region between the discharge space and a first sealed end of the discharge vessel. This coating forms, with the first electrode of the high-pressure discharge lamp which protrudes out of the first sealed end and into the discharge space, a capacitor, the quartz glass of the discharge vessel lying therebetween and the filling gas in the discharge space forming the dielectric of this capacitor. As a result, a dielectric barrier discharge between the first electrode and the coating is generated in the discharge space, in particular by means of the high-frequency components of the ignition pulse. This dielectric barrier discharge generates a sufficient number of free charge carriers in the discharge space for enabling the electrical breakdown between the two electrodes of the high-pressure discharge lamp or for significantly reducing the ignition voltage required therefor. The invention is therefore particularly well suited for mercury-free metal-halide high-pressure discharge lamps which, owing to the lack of mercury, have an increased ignition voltage.

Figure 4:
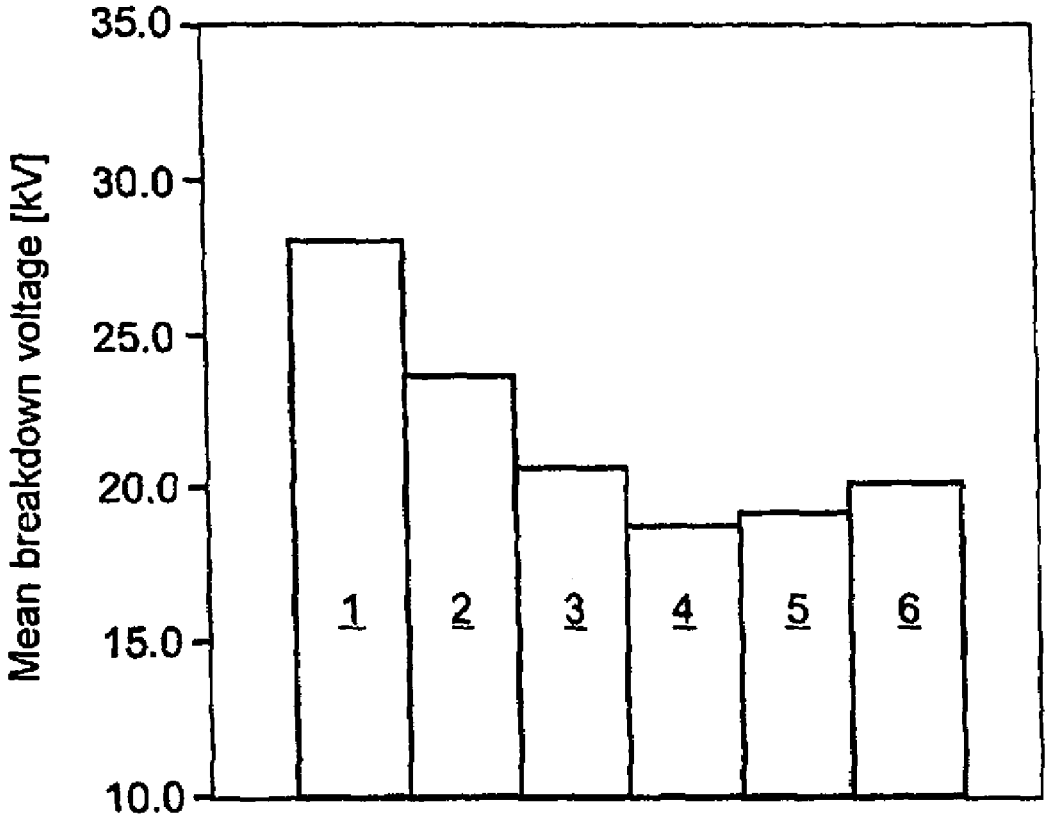

Advantageously, the coating in the form of an ignition aid is additionally also arranged in the boundary region between the discharge space and the second sealed end of the discharge vessel. FIG. 4 illustrates the mean breakdown voltage of the discharge path in the high-pressure discharge lamp for a plurality of high-pressure discharge lamps without an ignition aid coating and for high-pressure lamps with an ignition aid coating with five different geometries. The evaluation shown in FIG. 4 is based in each case on a plurality of high-pressure discharge lamps for each of the five coating geometries, which high-pressure discharge lamps were used to form a mean value for the breakdown voltage. The mean breakdown voltage for high-pressure discharge lamps without an ignition aid coating (1st bar in FIG. 4) is approximately 28.1 kV, while in the case of high-pressure discharge lamps with a coating (2nd bar in FIG. 4) which is arranged in the boundary region between the discharge space and the first sealed end of the discharge vessel and additionally also in the boundary region between the discharge space and the second sealed end of the discharge vessel, the mean breakdown voltage is reduced to approximately 23.4 kV. Preferably, the coating extends in the boundary region or in the boundary regions over the entire circumference of the discharge vessel. The boundary region between the discharge space and the sealed first end of the discharge vessel or the boundary regions between the discharge space and the sealed ends of the discharge vessel is/are preferably in each case formed by a groove which runs circumferentially around the discharge vessel in annular fashion. This results in a particularly small distance between the ignition aid coating and the respective electrode of the high-pressure discharge lamp and therefore in particularly effective capacitive coupling between the coating and the corresponding electrode.

Advantageously, the coating is additionally applied on a surface section of the first sealed end of the discharge vessel. As a result, the required high voltage for igniting the gas discharge in the high-pressure discharge lamp can be further reduced. As shown by the 3rd bar in FIG. 4, the mean breakdown voltage for high-pressure discharge lamps with an ignition aid coating which extends over a section of the surface of the first sealed end and the two boundary regions between the discharge space and the sealed ends is only approximately 20.6 kV.

In accordance with the two particularly preferred exemplary embodiments of the invention, the ignition aid coating is also extended onto a surface section of that part of the discharge vessel which surrounds the discharge space, with the result that the ignition aid coating preferably extends onto a surface section of the first sealed end and of that part of the discharge vessel which surrounds the discharge space and onto the two boundary regions between the discharge space and the sealed ends of the discharge vessel. In accordance with the two preferred exemplary embodiments, the ignition aid coating forms a strip which runs on the surface of the first sealed end and of the abovementioned part of the discharge vessel which surrounds the discharge space. The 4th and 5th bars in FIG. 4 show that, as a result, the mean breakdown voltage of the high-pressure discharge lamps is reduced to a value of approximately 18.8 kV and 19.3 kV, respectively. The exemplary embodiment with the lowest mean breakdown voltage which is associated with the 4th bar in FIG. 4 differs from the exemplary embodiment associated with the 5th bar in FIG. 4 by a coating which is formed in the region of the discharge vessel as a comparatively narrow strip on the discharge vessel surface, while, in the exemplary embodiment associated with the 5th bar in FIG. 4, the coating is formed in the region of the discharge vessel as a broad strip. Surprisingly, high-pressure discharge lamps with an ignition aid coating which extends over the two sealed ends of the discharge vessel and is formed mirror-symmetrically with respect to the plane arranged through the discharge vessel center point and perpendicular to the longitudinal axis of the discharge vessel have a slightly higher mean breakdown voltage than the two preferred asymmetrical ignition aid coatings which only extend onto the first sealed end, but not onto the second sealed end of the discharge vessel. As shown by the 6th bar in FIG. 4, the mean breakdown voltage for high-pressure discharge lamps with the abovementioned symmetrical ignition aid coating which is arranged on the two abovementioned boundary regions, the surfaces of the two sealed ends and a surface section of that part of the discharge vessel which surrounds the discharge space is approximately 20 kV.

Preferably, the abovementioned first sealed end of the discharge vessel is that end whose power supply line and electrode have the high-voltage pulses required for the ignition of the gas discharge in the high-pressure discharge lamp applied to them. As a result, the abovementioned dielectric barrier discharge between the electrode or power supply line protruding out of the first sealed end and the ignition aid coating is produced.

The invention can advantageously be applied in high-pressure discharge lamps which are provided for operation in the horizontal position, with electrodes arranged in a horizontal plane, such as, for example, in metal-halide high-pressure discharge lamps for motor vehicle headlamps. In this case, the surface section, which is provided with the ignition aid coating, of that part of the discharge vessel which surrounds the discharge space is arranged beneath the electrodes. As a result, the coating reflects some of the infrared radiation generated by the discharge back into the discharge space and therefore ensures selective heating of the colder regions of the discharge vessel which are located beneath the electrodes and in which the metal halides used for the light generation accumulate. As a result, the efficiency of the lamp can be increased without the hot regions of the discharge vessel which lie above the electrodes likewise being heated. In addition, the application of the coating only on the colder underside of the discharge vessel reduces the thermal loading of the coating, with the result that correspondingly fewer demands can be placed on the thermal loading capacity of the coating materials.

The ignition aid coating of the high-pressure discharge lamps according to the invention is preferably designed to be transparent in order to ensure as little light absorption as possible and as high a luminous efficiency as possible.

Preferably, the power supply line which is passed out of the first sealed end of the discharge vessel is connected to at least one molybdenum foil embedded in the first sealed end, and the at least one molybdenum foil is oriented in such a way that one of its two sides faces the coating arranged on the surface section of the first sealed end. As a result, capacitive coupling between the abovementioned molybdenum foil and the ignition aid coating applied on the first sealed end is achieved.

III. DESCRIPTION OF THE PREFERRED EXEMPLARY EMBODIMENT

Figure 1:
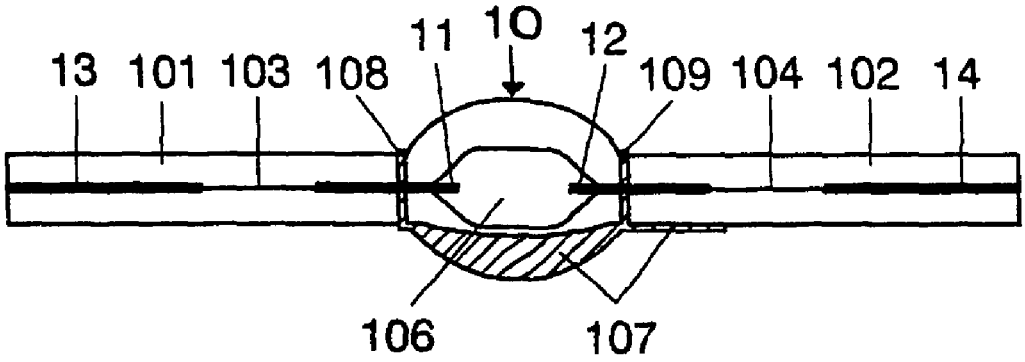
Figure 2:
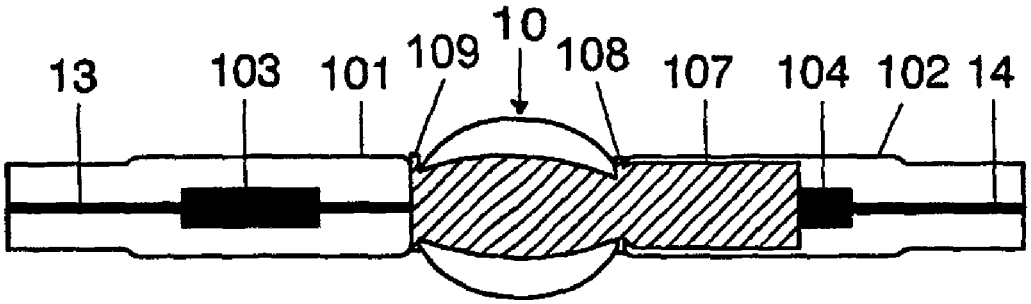
Figure 3:
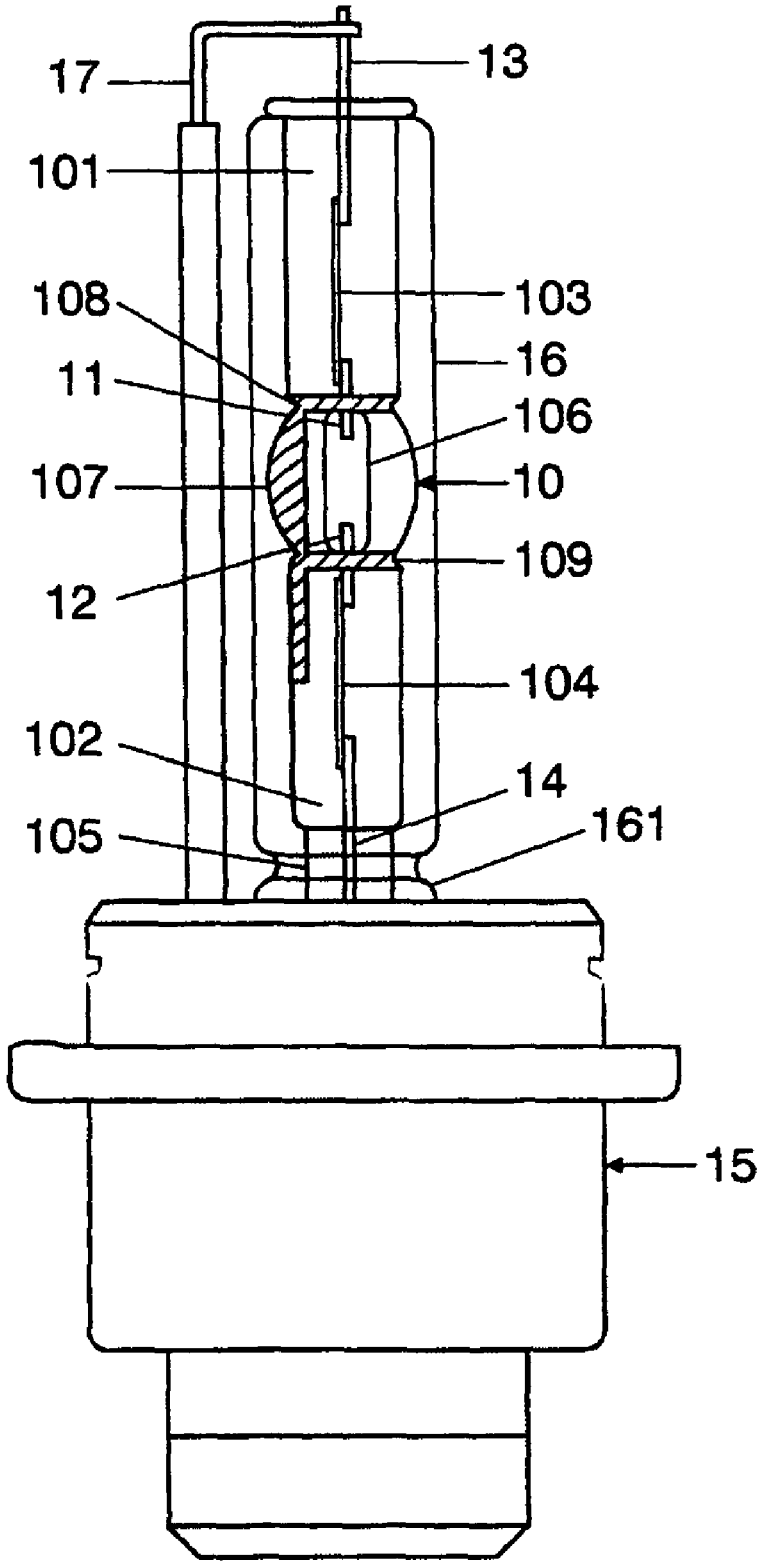

The invention will be explained in more detail below with reference to a preferred exemplary embodiment. In the drawing:

FIG. 1 shows a side view of the discharge vessel of the high-pressure discharge lamp depicted in FIG. 3 in accordance with the preferred exemplary embodiment, FIG. 2 shows a side view of the discharge vessel of the high-pressure discharge lamp depicted in FIG. 3 in accordance with the preferred exemplary embodiment in a view rotated through an angle of 90° about the longitudinal axis of the discharge vessel in comparison with FIG. 1 (underside corresponding to the installed position), FIG. 3 shows a side view of the high-pressure discharge lamp in accordance with the preferred exemplary embodiment of the invention, FIG. 4 shows a comparison of the mean breakdown voltage for high-pressure discharge lamps without ignition aid coating and with various ignition aid coatings.

The preferred exemplary embodiment of the invention illustrated schematically in FIG. 3 is a mercury-free metal-halide high-pressure discharge lamp with an electrical power consumption of approximately 35 watts. This lamp is provided for use in a motor vehicle headlamp. It has a discharge vessel 10 which is made from quartz glass, is sealed at two ends and has a volume of 24 $mm^3$, and in which an ionizable filling, consisting of xenon and halides of the metals sodium, scandium, zinc and indium, is enclosed in a gas-tight manner. In the region of the discharge space 106, the inner contour of the discharge vessel 10 is circular-cylindrical and its outer contour is ellipsoidal. The inner diameter of the discharge space 106 is 2.6 mm and its outer diameter is 6.3 mm. The two ends 101, 102 of the discharge vessel 10 are each sealed by means of a molybdenum foil fuze seal 103, 104. Two electrodes 11, 12 are located in the interior of the discharge vessel 10, and the discharge arc responsible for the light emission is formed during lamp operation between said electrodes. The electrodes 11, 12 consist of tungsten. Their thickness and their diameter is 0.30 mm. The distance between the electrodes 11, 12 is 4.2 mm. The electrodes 11, 12 are each electrically conductively connected to an electrical terminal of the lamp base 15, which substantially consists of plastic, via one of the molybdenum foil fuze seals 103, 104 and via the power supply wire 13 remote from the base and the power return line 17 or via the base-side power supply wire 14. The discharge vessel 10 is enveloped by a vitreous outer bulb 16. The outer bulb 16 has a protrusion 161 anchored in the base 15. On the base side, the discharge vessel 10 has a tubular extension 105 made from quartz glass, in which the base-side power supply line 14 runs.

That surface region of the discharge vessel 10 which faces the power supply line 17 is provided with a transparent, electrically conductive coating 107. This coating 107 extends in the longitudinal direction of the lamp over the entire length of the discharge space 106 and over part, approximately 50%, of the length of the base-side, sealed end 102 of the discharge vessel 10. The coating 107 is applied on the outside of the discharge vessel 10 and extends, for example, over approximately 5% to 50% of the circumference of the discharge vessel 10. It is formed as a strip in the region of the discharge space 106 and in the region of the base-side sealed end 102. In the boundary region 109 between the base-side sealed end 102 and the discharge space 106 and in the boundary region 108 between the sealed end 101 remote from the base and the discharge space 106 the coating 107 is in each case formed as a ring, which surrounds the discharge vessel 10. The boundary regions are formed by an annular groove 108, 109 which runs circumferentially around the discharge vessel 10, a so-called curl, in which the discharge vessel 10 has the smallest diameter and therefore there is a particularly small distance between the ignition aid coating 107 and the corresponding electrode 11 or 12. The coating 107 consists of doped tin oxide, for example of tin oxide doped with fluorine or antimony. The layer thickness of the ignition aid coating 107 is preferably selected in such a way that the resistance of the ignition aid coating 107, measured between any two points arranged at a distance of 1 cm on the ignition aid coating 107, is of the order of magnitude of approximately 1 ohms. The mean breakdown voltage of the discharge path of the high-pressure discharge lamp with the ignition aid coating 107 illustrated in FIGS. 1 to 3 is approximately 19.3 kV, corresponding to the 5th bar in FIG. 4.

The interspace between the outer bulb 16 and the discharge vessel 10 is preferably filled with an inert gas with a coldfilling pressure in a range of from 5 kPa to 150 kPa to which a small quantity of oxygen is admixed. The oxygen quantity is fed in such a way that, firstly, diffusion of oxygen out of the tin oxide layer 107 is prevented and, secondly, no oxidation of the dopants in the tin oxide coating 107 is caused. Even a few ppm as an oxygen content, for example 100 ppm of oxygen content (by weight) is sufficient for this purpose in the filling gas of the outer bulb. The inert gas is preferably nitrogen or a noble gas or a noble gas mixture or a nitrogen/noble gas mixture.

This high-pressure discharge lamp is operated in the horizontal position, i.e. with electrodes 11, 12 arranged in a horizontal plane, the lamp being aligned in such a way that the power return line 17 runs beneath the discharge vessel 10 and the outer bulb 16. The high voltage pulses required for igniting the gas discharge in the high-pressure discharge lamp are supplied to the base-side electrode 12 via the power supply line 14 since the base-side power supply line 14 is completely surrounded by the lamp vessels 10, 16 and the base 15 and therefore excellent electrical insulation of those parts of the high-pressure discharge lamp which conduct a high voltage is ensured. The abovementioned high voltage pulses are generated, for example, by means of a pulse ignition apparatus, whose components can be arranged in the lamp base 15.

The invention is not restricted to the exemplary embodiment explained in more detail above. For example, with the ignition aid coating 107 described in more detail above in the region of the discharge space 106 it is possible to reduce the width of the strip-like section of the coating 107, with the result that the coating 107 in the region of the discharge space 106 has a markedly narrower width than the section of the coating 107 arranged on the base-side end 102. As a result, the breakdown voltage of the discharge path of the high-pressure discharge lamp in accordance with the 4th bar in FIG. 4 can be reduced to approximately 18.8 kV. In addition, the ignition aid coating 107 in the region of the base-side sealed end 102 and/or in the region of the discharge vessel 106 can extend over the entire circumference of the discharge vessel 10. In addition, however, it is also possible for the discharge vessel 10 depicted in FIGS. 1 and 2 with the ignition aid coating 107 to be fitted in the lamp base 15 in such a way that the sealed end 102 which is provided with the ignition aid coating 107 is formed as the end remote from the base and the uncoated sealed end 101 of the discharge vessel 10 is formed as the base-side end of the high-pressure discharge lamp. In other words, the ignition aid coating 107 can also be arranged on the end 101 of the discharge vessel 10 of the high-pressure discharge lamp which is remote from the base instead of on the base-side end 102. The ignition aid coating 107 can, however, also extend on the two sealed ends 101, 102 of the discharge vessel 10. Given an asymmetrical design of the coating 107, i.e. if the coating 107 only extends on one of the two ends 101 or 102, the ignition voltage is preferably polarized in such a way that the electrode 11 or 12 present in the coated end 101 or 102 is connected to the positive pole of the ignition voltage or, in the case of unipolar, negative ignition voltage pulses, to ground.

Instead of the abovementioned material, the coating 107 can also consist of another transparent, electrically conductive material. For example, it may be in the form of a so-called ITO layer, i.e. an indium tin oxide layer. The ITO layer can have, for example, a content of 90 percent by weight of indium oxide and 10 percent by weight of tin oxide. In addition, the coating 107 can be coupled, for example, using suitable means electrically to an ignition apparatus in order to apply voltage pulses for igniting the gas discharge in the discharge space 106 via the coating 107 to the high-pressure discharge lamp. In addition, the invention can also be applied to the conventional mercury-containing metal-halide high-pressure discharge lamps in order to achieve the above-described advantages.

In order to ignite the gas discharge in the high-pressure discharge lamp according to the invention, an ignition apparatus which generates the high voltage required for igniting the gas discharge by means of the magnification factor method can be used instead of a pulse ignition apparatus.

The invention claimed is:

1. A high pressure discharge lamp comprising: a discharge vessel having a first seal at a first end and a second seal at a second end, the two seals defining a discharge space within the discharge vessel; an ionizable filling enclosed in the discharge space for enabling gas discharge; a first electrode and a second electrode disposed at the first and second ends of the discharge vessel respectively and exposed to the ionizable filling; a main power supply line and a return power supply line respectively connected to the first and second electrodes and respectively extending through the first and second seals at the ends of the discharge vessel, the main power supply line for providing an ignition voltage to the first electrode; an ignition aid comprising an electrically conductive material capacitively coupled to each of the electrodes, at least one of said couplings extending across at least a portion of the discharge space; wherein at least a portion of the electrically conductive material comprises a coating disposed over the surface of the first seal at the first end of the discharge vessel, wherein the coating extends in a first annular groove between the discharge space and the first seal at the first end of the discharge vessel.

2. The discharge lamp of claim 1, wherein the coating extends in a second annular groove between the discharge space and the second end of the discharge vessel.

3. The discharge lamp of claim 1, wherein operation takes place in the horizontal position with the electrodes arranged in a horizontal plane, the coating being arranged on the surface section of that part of the discharge vessel which is disposed on the discharge space beneath the horizontal plane of the electrodes.

4. The discharge lamp of claim 1, wherein the main power supply line is connected to at least one molybdenum foil embedded in the first seal at the first end, the at least one molybdenum foil has two major surfaces and is oriented in such a way that one of said two major surfaces faces the coating arranged on the surface of the first seal at the first end.

5. The discharge lamp of claim 1, wherein the conductive coating is transparent.

6. The discharge lamp of claim 1, wherein the return power supply line extends adjacent and parallel to the discharge vessel and is grounded with respect to the main power supply;

wherein the conductive coating disposed over the surface of the first seal at the first end is oriented to face the return power supply line.

7. A high pressure discharge lamp comprising: a discharge vessel having a first seal at a first end and a second seal at a second end, the two seals defining a discharge space within the discharge vessel; an ionizable filling enclosed in the discharge space for enabling gas discharge; a first electrode and a second electrode disposed at the first and second ends of the discharge vessel respectively and exposed to the ionizable filling; a main power supply line and a return power supply line respectively connected to the first and second electrodes and respectively extending through the first and second seals at the ends of the discharge vessel, the main power supply line for providing an ignition voltage to the first electrode; an ignition aid comprising an electrically conductive material capacitively coupled to each of the electrodes, at least one of said couplings extending across at least a portion of the discharge space; wherein the electrically conductive material comprises a coating disposed over a greater portion of the surface of the first end, as compared to any coating disposed on the second end, wherein the coating extends in a first annular groove between the discharge space and the first end of the discharge vessel.

8. The discharge lamp of claim 7, wherein the coating extends in a second annular groove between the discharge space and the second end of the discharge vessel.

9. The discharge lamp of claim 8, wherein operation takes place in the horizontal position with electrodes arranged in a horizontal plane, the coating being arranged on the surface section of that part of the discharge vessel which is disposed on the discharge space beneath the horizontal plane of the electrodes.

10. The discharge lamp of claim 7, wherein the main power supply line is connected to at least one molybdenum foil embedded in the first seal at the first end, the at least one molybdenum foil has two major surfaces and is oriented in such a way that one of said two major surfaces faces the coating arranged on the surface of the first seal at the first end.

11. The discharge lamp of claim 7, wherein the conductive coating is transparent.

12. The discharge lamp of claim 7, wherein the return power supply line extends adjacent and parallel to the discharge vessel and is grounded with respect to the main power supply;

wherein the conductive coating disposed over the surface of the first seal at the first end is oriented to face the return power supply line.

* * * * *